US007341169B2

(12) United States Patent
Bayer

(10) Patent No.: US 7,341,169 B2
(45) Date of Patent: Mar. 11, 2008

(54) AUTOMATIC PURGING AND EASY DISPENSING AEROSOL VALVE SYSTEM

(75) Inventor: Christian Bayer, Armonk, NY (US)

(73) Assignee: Precision Valve Corporation, Yonkers, NY (US)

( * ) Notice: Subject to any disclaimer, the term of this patent is extended or adjusted under 35 U.S.C. 154(b) by 429 days.

(21) Appl. No.: 11/099,005

(22) Filed: Apr. 5, 2005

(65) Prior Publication Data

US 2006/0219740 A1 Oct. 5, 2006

(51) Int. Cl.
*B65D 83/00* (2006.01)
*B67D 5/006* (2006.01)
*B67D 5/06* (2006.01)

(52) U.S. Cl. ..... 222/402.24; 222/402.1; 222/145.5; 222/145.2

(58) Field of Classification Search ..... 222/402.18, 222/144.5, 402.17, 402.24, 145.2, 402
See application file for complete search history.

(56) References Cited

U.S. PATENT DOCUMENTS 2,658,714 A 11/1953 Fooshee
3,257,035 A 6/1966 Jones
3,406,877 A 10/1968 Frangos
3,575,320 A * 4/1971 Prussin et al. ..... 222/144.5
3,610,481 A 10/1971 Marraffino
3,733,009 A 5/1973 Rouzier et al.
3,749,291 A * 7/1973 Prussin et al. ..... 222/402.24
3,982,674 A 9/1976 Mildern
4,211,347 A 7/1980 Mildern
4,405,064 A 9/1983 Stoody
4,431,119 A 2/1984 Stoody
5,695,096 A 12/1997 Yquel
5,941,424 A 8/1999 Hildebrandt
6,520,377 B2 2/2003 Yquel
6,588,628 B2 7/2003 Abplanalp et al.

FOREIGN PATENT DOCUMENTS

GB 2 209 805 A 5/1989

* cited by examiner

*Primary Examiner*—Kevin Shaver
*Assistant Examiner*—Melvin A. Cartagena
(74) *Attorney, Agent, or Firm*—Kilgannon & Steidl

(57) ABSTRACT

Self-purging, low force opening, aerosol valve system with an orificed valve stem groove and gasket forming a first valve for product and propellant, or propellant, flow. A check valve element, biasing element and housing first opening form a second valve for product flow. Actuating the valve stem sequentially opens first valve and then second valve. After actuation, second valve closes before first valve, and propellant from housing second opening purges valve stem and actuator until first valve closes. No first valve closing return spring acts directly on valve stem, allowing easy opening. Gasket in stem groove and product and propellant flow fully close first valve after second valve closes. High solid and/or resin content products can be dispensed through an actuator with mechanical break-up insert.

7 Claims, 5 Drawing Sheets

AUTOMATIC PURGING AND EASY DISPENSING AEROSOL VALVE SYSTEM

FIELD OF THE INVENTION

The present invention relates to aerosol valve systems to dispense products from pressurized aerosol containers and, more particularly, relates to an easy-to-open valve assembly that automatically purges product in the valve stem during full closure of the valve assembly.

BACKGROUND OF THE INVENTION

Certain products dispensed by aerosol valves have a high solid and/or resin content formulation susceptible to clogging the aerosol valve and actuator after use, for example paint and certain hairsprays and antiperspirants. It is well known that the users of paint in aerosol containers are instructed to invert the container after use and operate the valve actuator until a clear spray of propellant issues the nozzle, thus indicating that substantial paint residue does not remain in the valve and actuator to clog and render inoperable the sprayer. In the process, significant propellant loss occurs. In addition, traditional paint valve systems do not lend themselves to the use of mechanical break-up inserts in the nozzle, such inserts having small channels which easily clog. The use of such inserts would be desirable to improve product spray patterns.

Aerosol valve systems have been conceived to partially obviate the above problems by providing self-purging (automatic purging) capabilities. However, such systems are expensive, involve multiple springs, require excessive force to open, do not function adequately, and/or are difficult to manufacture or assemble. An example of a multiple spring system is shown in U.S. Pat. No. 3,749,291 (Prussin, Mason).

Aerosol valves generally are operated by metal return springs that contact and act directly upon the valve stem body to return it to its closed position after actuation of the valve ceases. The spring has a significant upward force, thus requiring a significant downward force by the user to open and maintain the aerosol open. The metal return spring also provides well-known corrosion problems with certain products, adds significant cost to the aerosol valve assembly, and requires a separate assembly operation. Plastic return springs have been suggested as an alternative, but can be difficult and expensive to mold, require a significant user force to open and maintain open, and are more subject to failure than metal return springs.

Various attempts have been made to eliminate valve return springs, whether metal or plastic. Most such attempts have been inadequate and/or overly complicated in concept and construction. One successful attempt is shown in U.S. Pat. No. 6,588,628 (Abplanalp, Bayer, Flynn) but it, as well as the other various attempts, do not provide or suggest a means for automatic purging of the valve of paint and other high solid/resin content products as discussed above.

SUMMARY OF THE INVENTION

The present invention is intended to provide a self-purging aerosol valve system that is also easy to open and characterized by the absence of any return spring acting directly upon the valve stem. The present invention is for use with a container holding a product to e dispensed and a propellant gas. The present invention comprises a mounting cup, a valve housing captured by the mounting cup, a valve stem extending within and above said valve housing, a valve stem sealing gasket which cooperates with the stem to comprise a first valve of the aerosol valve system, a valve housing extension, and a check valve element and biasing element positioned within the valve housing extension and comprising a second valve of the aerosol valve system. The biasing element may be a spring or a flexible membrane with blockable openings, for example. The valve housing has a first opening, and a second opening for entry of propellant gas from the container into the valve housing. The check valve element, for example a check ball or a portion of a flexible membrane, and said first opening in the valve housing comprise a second valve of the valve system. The valve stem has an internal channel for product dispensing, one or more orifices extending through the side wall of the stem for product and gas entry into the stem internal channel, and an annular groove in the stem side wall within which the stem gasket seats and seals said one or more orifices when the aerosol valve stem is not actuated. The valve housing extension has an opening therein for product in the container to enter. The biasing element in the valve housing extension biases the check valve element in the valve housing extension against the valve housing first opening when the aerosol valve is not actuated; said aerosol valve stem when actuated first unsealing said one or more stem orifices and only thereafter unseating the check valve element by action of the stem against the check valve element to allow product to enter the valve housing extension, valve housing, the one or more stem orifices and the stem internal channel. The aerosol valve system, when actuation ceases, results in the biased check valve element pushing the stem upwardly and closing the said second valve to product flow, followed thereafter, before the first valve is closed, by stem separation from the check valve element and propellant gas flow through the housing said second opening and through the stem one or more orifices and internal channel to purge remaining product in the housing, stem and actuator until said first valve is closed. The aerosol valve is further characterized by the absence of any return spring acting directly upon the valve stem to fully close the first valve or resist initially opening the first valve. The closing of the first valve is initiated by the check valve element biasing the valve stem upward followed, after separation of the check valve element and stem, by the gasket acting against the stem groove to assist in full closure of the first valve.

The present invention provides a low force valve opening since there is no return spring present to act against, and the valve stem upon actuation moves a certain distance before encountering the biased check valve element. As opposed to a two spring purging valve where the valve stem is working against and compressing a contacting return spring from the very beginning of depressing the valve stem, in the present invention the initial depression requires considerably less force by the user. Maintaining the valve system open also requires less force. Further, when the actuation ceases and the valve stem has separated from the check valve element, the valve system will still close completely while self purging without a need for the valve stem return spring. Mechanical break-up inserts may also be used in the valve actuator without fear of clogging by high solid and/or resin product formulations. The design of the present invention also is simple and economical to manufacture and assemble.

Other features and advantages of the present invention will be apparent from the following description, drawings and claims.

DETAILED DESCRIPTION OF THE EMBODIMENT

Figure 1:
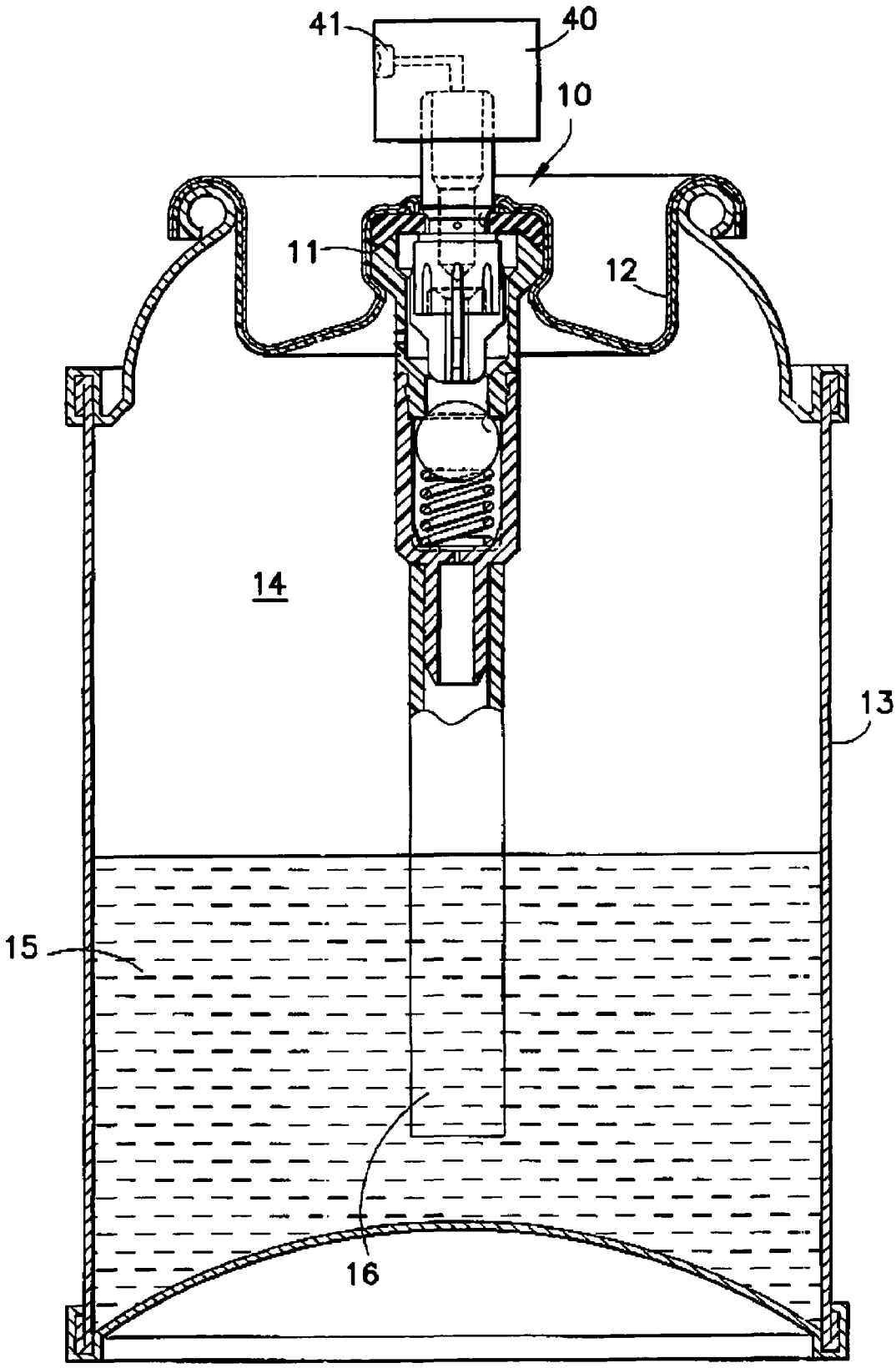
FIG. 1 is a side elevational view in partial section of the aerosol valve assembly of the present invention mounted in an aerosol container holding product and propellant.

Referring to FIG. 1 an aerosol valve system or assembly designated generally as 10 is fitted and crimped into the pedestal portion 11 of a metal mounting cup closure 12 for a pressurized aerosol container 13. Container 13 is a single compartment containing both propellant 14 and one of the aforementioned products 15 to be dispensed. When the aerosol valve assembly is fully open, propellant 14 will force product 15 up through the conventional dip tube 16 and valve assembly 10 to be dispensed to the outside environment, propellant 14 also entering the valve assembly and mixing with the product, all in a manner as described hereinafter.

Figure 2:
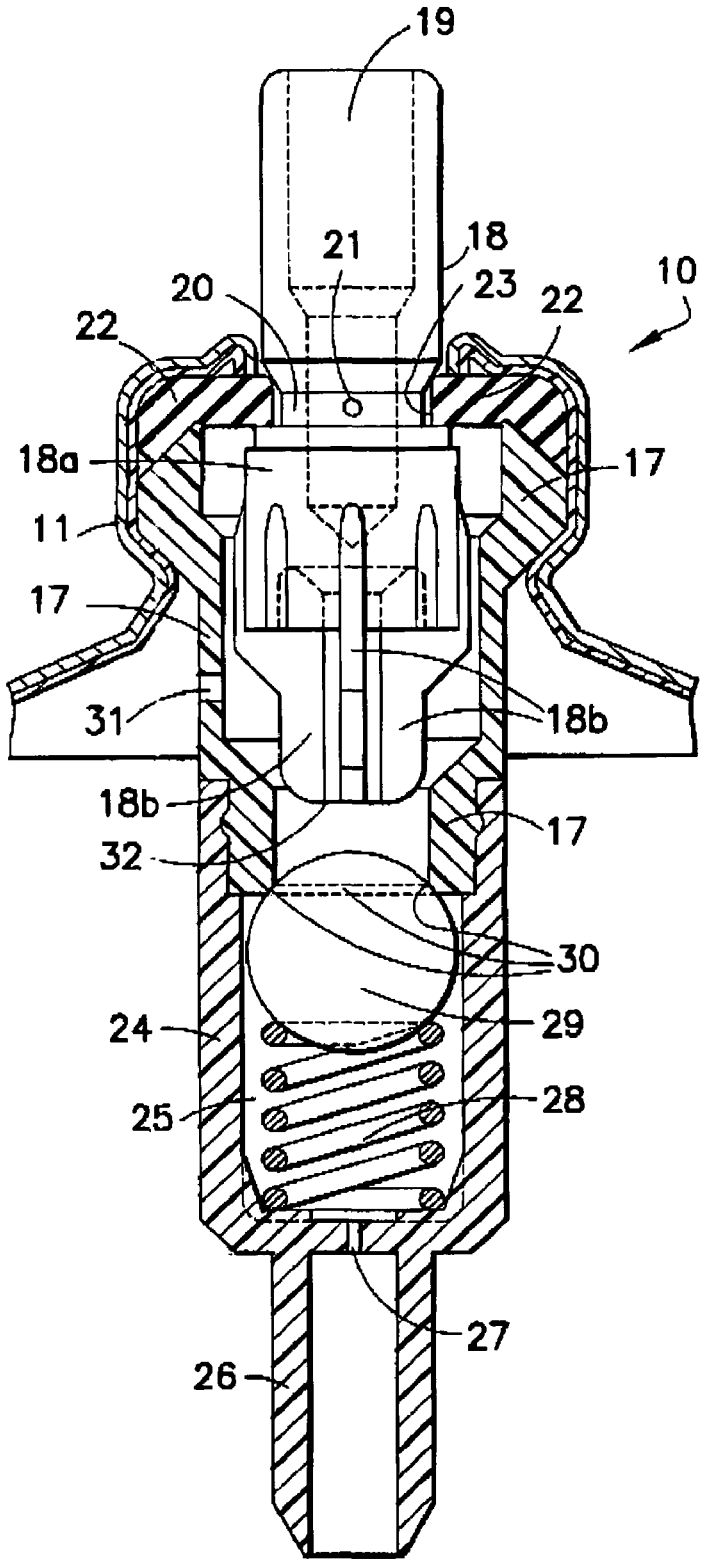
FIG. 2 is a side elevational view in partial section of the aerosol valve assembly of the present invention, the valve assembly being shown in closed position.

FIG. 2 illustrates the aerosol valve system 10 in a closed position. Valve housing 17 is captured at the pedestal 11 of the mounting cup in conventional fashion. Valve stem 18 extends both within and above valve housing 17. Valve stem 18 includes internal channel 19 for product dispensing, annular groove 20 in its side wall, and one or more orifices 21 in groove 20 through the stem side wall communicating with internal channel 19. Annular resilient sealing gasket 22 with central opening 23 cooperates with stem 18 to form a first valve of the valve system 10. Annular gasket 22 seats within annular groove 20 of the valve stem and seals the one or more orifices 21 from product or propellant entry into the stem internal channel 19. A conventional actuator 40 (see FIG. 1) will sit upon the top of stem 18 and is used to actuate the aerosol valve assembly. Actuator 40 includes a conventional mechanical break-up insert 41 at its nozzle. The middle portion 18*a* of valve stem 18 is essentially cylindrical. Extending below portion 18*a* are four stem legs 18*b* spaced ninety degrees apart, three of which legs are shown in FIG. 2.

Valve housing 17 has a downwardly extending valve housing extension 24 which defines an internal space 25, has a bottom protruding nipple 26 for attachment of a conventional dip tube 16, and has an opening 27 into the interior space 25 for product entry from the container. Within interior space 25 is positioned a biasing spring 28 to bias check ball 29 against first opening 30 in the bottom of valve housing 17 in the FIG. 2 position. Check ball 29 and first opening 30 comprise a second valve of the valve system 10. Valve housing extension 24 may be a separate member attached to valve housing 17 as shown, or may be made integral with valve housing 17. In the latter event, an integral flange or narrowing internal to the housing or an interference fit washer in the housing will define an opening to effectively serve as the first opening in the valve housing against which check ball 29 is biased. Valve housing 17 also has second opening 31 in its side wall for entry of propellant 14 into the valve housing as discussed hereafter.

Figure 3:
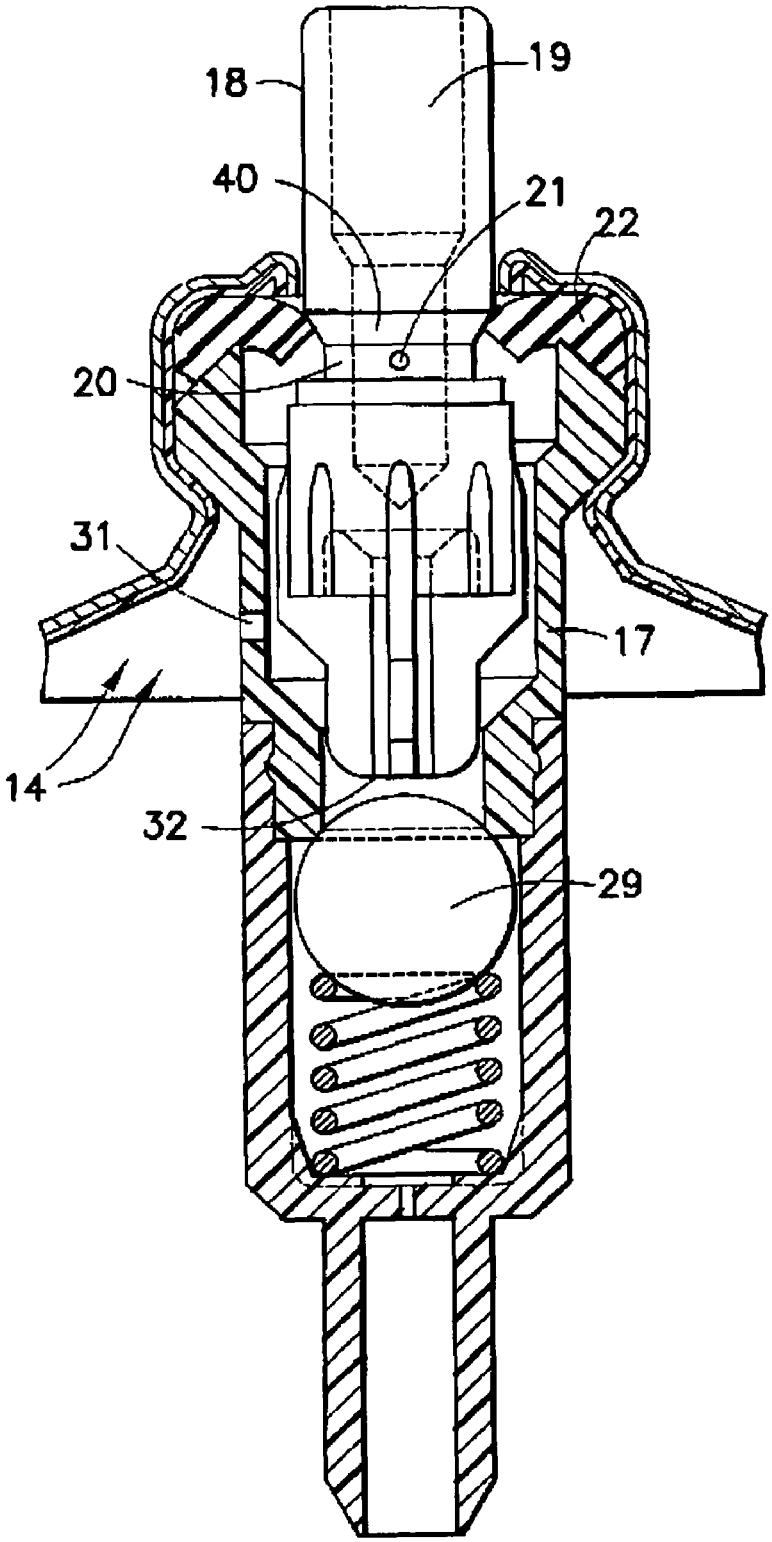
FIG. 3 is a side elevational view in partial section corresponding to FIG. 2, but with the valve assembly being shown in partially open or partially closed purging position wherein only propellant is flowing.
Figure 4:
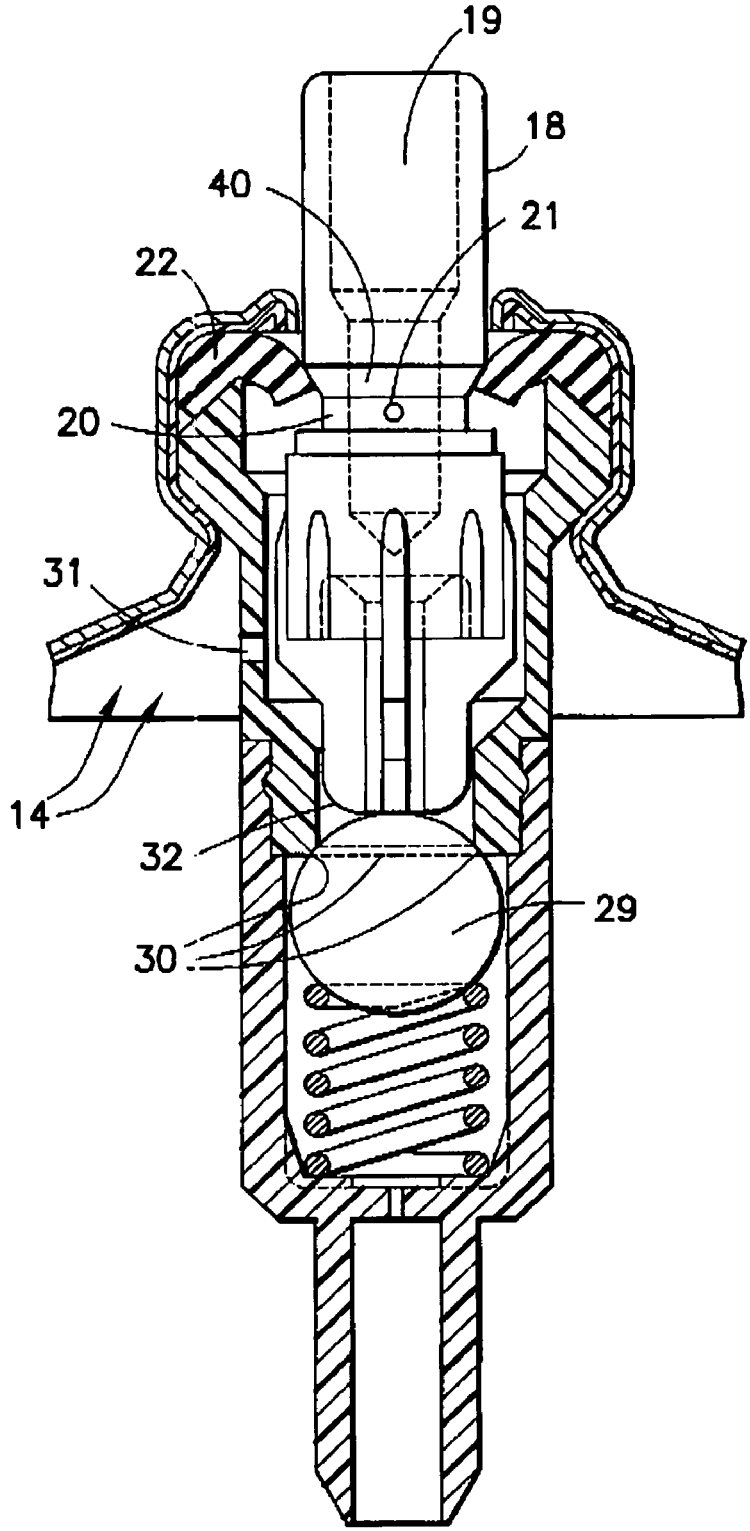
FIG. 4 is a side elevational view in partial section corresponding to FIG. 2, but with the valve assembly being shown in a further partially open or partially closed purging position wherein only propellant is flowing.

Turning now to the operation of the aerosol valve system of the present invention, reference is made to FIG. 3. FIG. 3 (and FIGS. 4 and 5) have the exact same parts as FIG. 2 described above, and only differ in the relative positioning of the parts. FIG. 3 illustrates the aerosol valve system in a partially open position, with stem 18 initially having been depressed from the FIG. 2 position. As can be seen, the bottom 32 of stem 18 is still spaced from check ball 29 (as it is in FIG. 2). Gasket 22 no longer is fully seated in groove 20 and no longer seals the one or more stem orifices 21. Propellant gas 14 enters valve housing side opening 31 and passes up to and through one or more stem orifices 21 and out stem channel 19 into the actuator 40 and out the nozzle of the actuator. In this process, propellant 14 cleans out any residual product in the stem and actuator in the unlikely event that any remains after the self-purging operation described hereinafter. Product at this opening stage has not yet passed through the system since the second valve remains closed by check ball 29. It will be noted that for the FIG. 3 stem position (and the stem position shown in FIG. 4), the downward actuating movement of stem 18 has not been resisted by any return spring normally in contact with and resisting the downward stem movement. The initial actuation of the valve thus requires less opening force, a feature important to users. FIG. 4 illustrates the bottom 32 of stem 18 depressed further on opening and just making contact with but not yet dislodging check ball 29 from its closed position against the sides of the first opening 30 in valve housing 17. The operating conditions of the aerosol valve system otherwise are as described above for FIG. 3.

Figure 5:
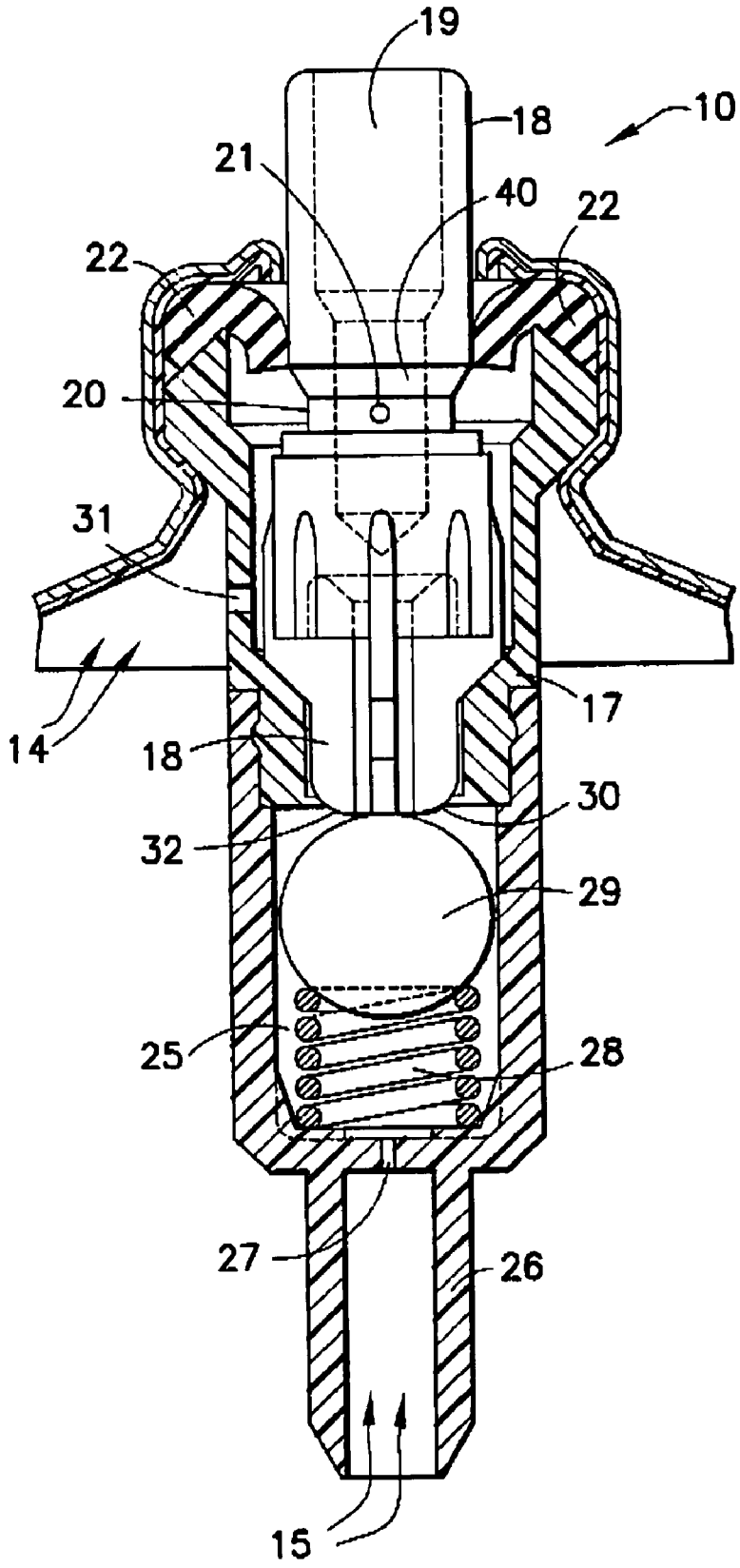
FIG. 5 is a side elevational view in partial section corresponding to FIG. 2, but with the valve assembly being shown in fully open position wherein both product and propellant are flowing.

Now referring to FIG. 5, the aerosol valve system is in full open, product dispensing position. The further depression of valve stem 18 has resulted in its bottom 32 dislodging check ball 29 from opening 30, ball 29 in turn compressing its biasing spring 28. Propellant 14 now forces product 15 up dip tube 16 (see FIG. 1) into nipple 26, through hole 27, into chamber 25 and around check ball 29 through opening 30, up along the sides of stem 18 in valve housing 17, into stem groove 20, and through the one or more stem orifices 21 into channel 19 of valve stem 18. At the same time, propellant gas 14 continues to flow through valve housing opening 31, to break up and be dispensed with product 15 out channel 19 of valve stem 18 and into and out of the actuator 40. It will be noted in this FIG. 5 position that gasket 22 is almost but not quite out of valve stem groove 20.

When actuation of the aerosol valve system ceases (i.e., the user's finger is removed from the actuator), product 15 continues to flow until check ball 29 is pushed by biasing spring 28 back to the FIG. 4 position, at which point check ball 29 seats against opening 30 to cut off further product flow. Gasket 22 now bears against the upper wall 40 of groove 20, and the resiliency of the rubber gasket 22 urges the stem 18 upwardly without the need of a conventional return spring. This upward urging of the stem 18 continues to the FIG. 3 position at which point the bottom 32 of stem 18 has separated from check ball 29.

In the above-described FIGS. 4 and 3 positions during the closing operation of the aerosol valve system, product flow has ceased through the second valve because of the seating of check ball 29 against opening 30. However, paint 15, for example, is still present in the interior of valve housing 17 and in stem orifices 21 and channel 19 and in the actuator. The one or more stem orifices 21 have not yet been sealed by gasket 22, and the automatic purging of that paint product in valve housing 17 and stem 18 takes over. Propellant 14 continues to flow through side opening 31 in the valve housing, and through groove 20, orifices 21 and channel 19, to remove and evacuate the paint or other product therein. In this manner, clogging by the drying out of residual product of the aforementioned nature that would otherwise remain in valve housing 17 and stem orifices 21 and stem 18, as well as in the actuator, is prevented. An additional benefit is that the actuator nozzle may use known mechanical break-up inserts with small channels.

As the closing of the aerosol valve system continues, gasket 22 continues to work against stem groove surface 40 until the resilient gasket 22 fully seats back into the groove 20 to seal the one or more stem orifices 21. This is the fully closed position as shown in FIG. 2. The product and propellant flows against the stem during the sequential FIGS. 3 and 2 closing operation also assist in fully closing the aerosol valve system.

It will be appreciated by persons skilled in the art that variations and/or modifications may be made to the present invention without departing from the spirit and scope of the invention. The present embodiment is, therefore, to be considered as illustrative and not restrictive. Positional terms as used in the specification are used and intended in relation to the positioning shown in the drawings, and are not otherwise intended to be restrictive.

What is claimed is:

1. A self-purging, low force opening, aerosol valve system for use with a container holding a product to be dispensed and a propellant gas, said aerosol valve system comprising in combination: a mounting cup, a valve housing captured by the mounting cup, a valve stem extending within and above said valve housing, a valve stem sealing gasket which cooperates with the stem to comprise a first valve of the aerosol valve system, a valve housing extension, and a check valve element and biasing element positioned within the valve housing extension; said valve housing having a first opening, and a second opening for entry of propellant gas from the container into the valve housing; said check valve element and said valve housing first opening comprising a second valve of the aerosol valve system; said valve stem having an internal channel for product dispensing, one or more orifices extending through the side wall of the stem for product and gas entry into the stem internal channel, and an annular groove in the stem side wall within which the stem gasket seats and seals said one or more orifices when the aerosol valve stem is not actuated; said valve housing extension having an opening therein for product in the container to enter the valve housing extension; said biasing element in the valve housing extension biasing said check valve element against said valve housing first opening when the aerosol valve is not actuated; said aerosol valve stem when actuated first unsealing said one or more stem orifices and only thereafter unseating said check valve element by action of the stem against the check valve element to allow product to enter the valve housing extension, valve housing, the one or more stem orifices and the stem internal channel; said aerosol valve system when actuation ceases resulting in the biased check valve element pushing the stem upwardly to close the said second valve to product flow, followed thereafter, before the first valve is closed, by stem separation from the check valve element and propellant gas flow through the housing said second opening and through the stem one or more orifices and internal channel to purge remaining product in the stem until said first valve is closed; said aerosol valve being further characterized by the absence of any return spring acting directly upon the valve stem to fully close the first valve or resist initially opening the first valve; and wherein the closing of the first valve is initiated by the check valve element biasing the valve stem upward followed, after separation of the check valve element and stem, by the gasket acting against the stem groove to assist in full closure of the first valve.

2. The aerosol valve system of claim 1, wherein said check valve element comprises a check ball.

3. The aerosol valve system of claim 1, wherein the valve housing extension is a separate member mounted to the valve housing.

4. The aerosol valve system of claim 1, wherein said biasing element is a biasing spring.

5. The aerosol valve system of claim 1, wherein said valve housing second opening extends through the side wall of the valve housing.

6. The aerosol valve system of claim 1, wherein said one or more orifices through the stem side wall are positioned in the annular groove in the stem side wall.

7. The aerosol valve system of claim 1, having an actuator mounted on the top of the stem, said actuator including a mechanical break-up insert at its nozzle.

* * * * *